US005582063A

United States Patent [19]

Hofele et al.

[11] Patent Number: 5,582,063

[45] Date of Patent: Dec. 10, 1996

[54] MULTISTAND PRESS OR SIMILAR PRESS FACILITY FOR FORMING SHEET METAL PARTS

[75] Inventors: Hans Hofele; Wolfgang Michael, both of Goeppingen; Hermann Braun, Salach; Franz Schneider, Goeppingen, all of Germany

[73] Assignee: L. Schuler GmbH, Germany

[21] Appl. No.: 271,678

[22] Filed: Jul. 7, 1994

[30] Foreign Application Priority Data

Jul. 8, 1993 [DE] Germany ..... 43 22 775.9

[51] Int. Cl.[6] ..... B21J 13/04

[52] U.S. Cl. ..... 72/455; 72/405.11

[58] Field of Search ..... 72/405, 404, 452, 72/455, 456, 405.11, 405.13

[56] References Cited

U.S. PATENT DOCUMENTS

| | | | |
|---|---|---|---|
| 142,250 | 8/1873 | Majer | 72/404 |
| 324,507 | 8/1885 | Walton | 72/404 |
| 3,564,898 | 2/1971 | Stettler | 72/452 |
| 3,785,194 | 1/1974 | Bradlee | 72/405 |
| 4,064,734 | 12/1977 | Pahnke | 72/455 |
| 4,089,205 | 5/1978 | Mizumoto | 72/455 |
| 4,364,257 | 12/1982 | Endo | 72/405 |

FOREIGN PATENT DOCUMENTS

| | | | |
|---|---|---|---|
| 0581008A2 | 6/1993 | European Pat. Off. . | |
| 2165365 | 7/1971 | Germany . | |
| 2359912 | 6/1975 | Germany | 72/405 |
| 2657911 | 7/1977 | Germany . | |
| 3827985 | 2/1990 | Germany | 72/404 |
| 58-93599 (A) | 6/1983 | Japan . | |
| 1292750 | 10/1972 | United Kingdom | 72/455 |
| 2227697 | 8/1990 | United Kingdom | 72/405 |

*Primary Examiner*—Daniel C. Crane

*Attorney, Agent, or Firm*—Evenson, McKeown, Edwards & Lenahan P.L.L.C.

[57] ABSTRACT

A multistand press or similar press facility for the forming of sheet metal parts, is provided with bedplate, press stand and several press slides driven by the press drive for tool top parts interacting with tool bottom parts. Gearings for deflecting the rotating movement of the motor drive into the upward and downward movement of the press slides are arranged between press stands which each form a pair of stands, and are disposed opposite one another, and above the introduction of force into the press slides. Two gearings are provided for the respective pair of stands of two press slides. This make it possible to drive the press slides assigned to a pair of press stands from one press stand area.

3 Claims, 5 Drawing Sheets

MULTISTAND PRESS OR SIMILAR PRESS FACILITY FOR FORMING SHEET METAL PARTS

BACKGROUND AND SUMMARY OF THE INVENTION

The present invention relates to a multistand press or similar press facility for the forming of sheet metal parts comprising press stands which are situated opposite one another. Press facilities of this type are used for forming a sheet bar, a round blank or similar sheet metal parts, in which case, in the first stage, the drawing may be provided for producing the starting form for the further shaping. The invention relates to those multistand presses which have at least two press slides, the slide drive being arranged above the press slide and the introduction of force taking place symmetrically with respect to its longitudinal center axis.

Press facilities of this general type are known, for example, from U.S. Pat. No. 4,102,174 and German Patent Documents DE-C2-31 18 955, DE-A1-39 05 068, and DE-A1-41 24 083. These documents show the use of several press slides in the progressive stations which follow the drawing station as well as intermediate depositing devices behind each machining station. The press constructions illustrated there are expensive, while the number of components is correspondingly high.

It is an object of the present invention to reduce the length of the overall production space by eliminating the intermediate depositing sites and placing the drives of the press slides in the area of the previously existing vacant station areas (intermediate stand area). In particular, the drive of two mutually abutting (progressive) press slides is to take place from an intermediate stand area.

This and other objects are achieved by the present invention which provides a multistand press facility for forming sheet metal parts, comprising press stands which are arranged opposite one another to form pairs of stands, and at least one bedplate between the press stands, the at least one bedplate carrying tool bottom parts. A press drive having a motor drive with a rotating movement is provided, as well as a plurality of press slides coupled to the press drive and driven by the press drive. The plurality of press slides are coupled to tool top parts that interact with the tool bottom parts when the press slides are driven. Gearings are coupled between the motor drive and the press slides, these gearings deflecting the rotating movement of the motor drive into upward and downward movements of the press slides. The gearings are arranged between the pairs of stands and above an introduction of force into the press slides. At least one of the pairs of stands is common for two of the press slides and two of the gearings are arranged between the press stands of the common pair of stands. The two gearings are respectively coupled to the two press slides.

Embodiments allowing the different drive of the adjacent press slides are particularly advantageous.

Other objects, advantages and novel features of the present invention will become apparent from the following detailed description of the invention when considered in conjunction with the accompanying drawings.

DETAILED DESCRIPTION OF THE DRAWINGS

Figure 1:
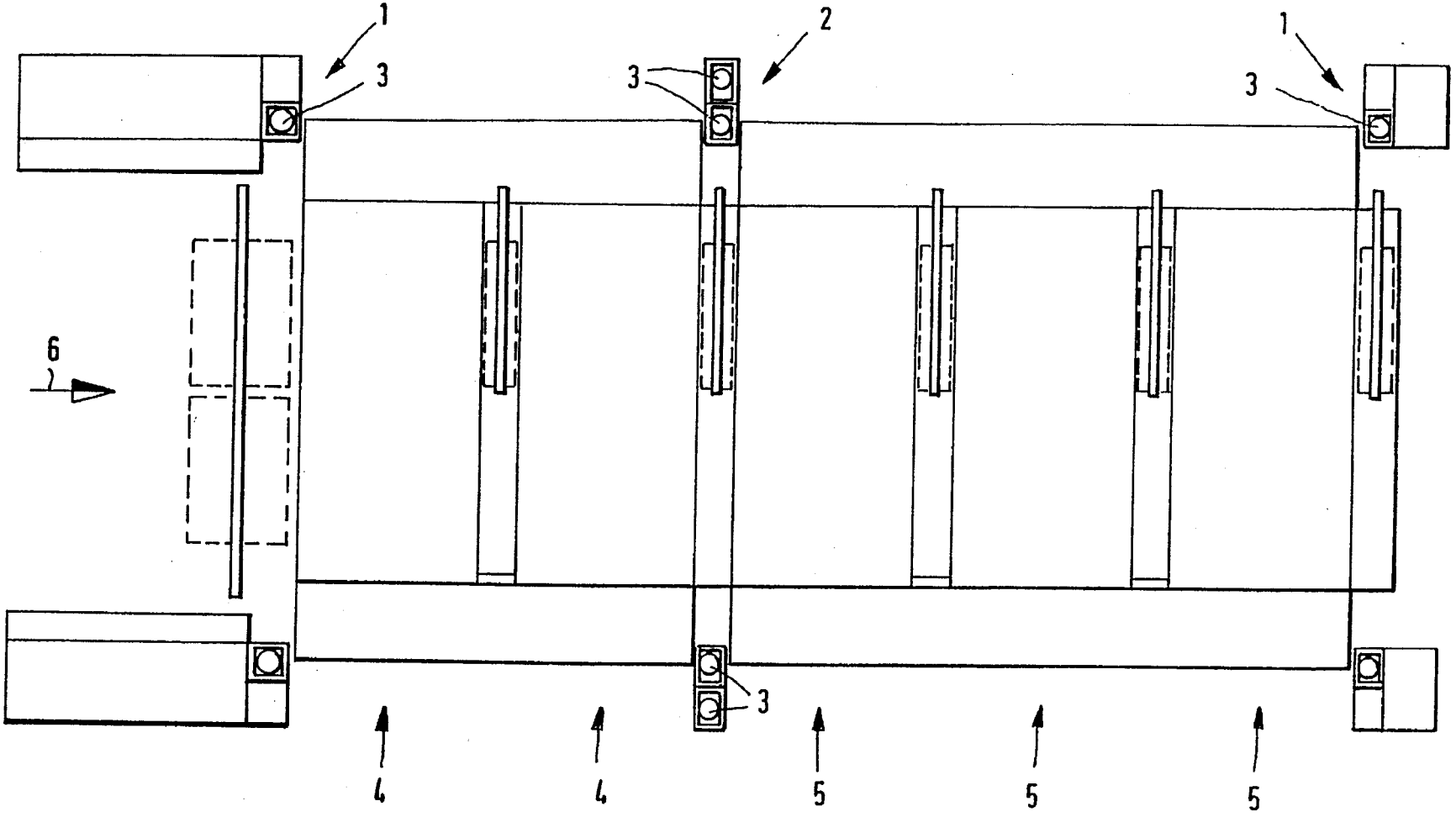
FIG. 1 is a top view of the basic structure of a press facility constructed in accordance with the present invention with machining or forming stations.
Figure 2:
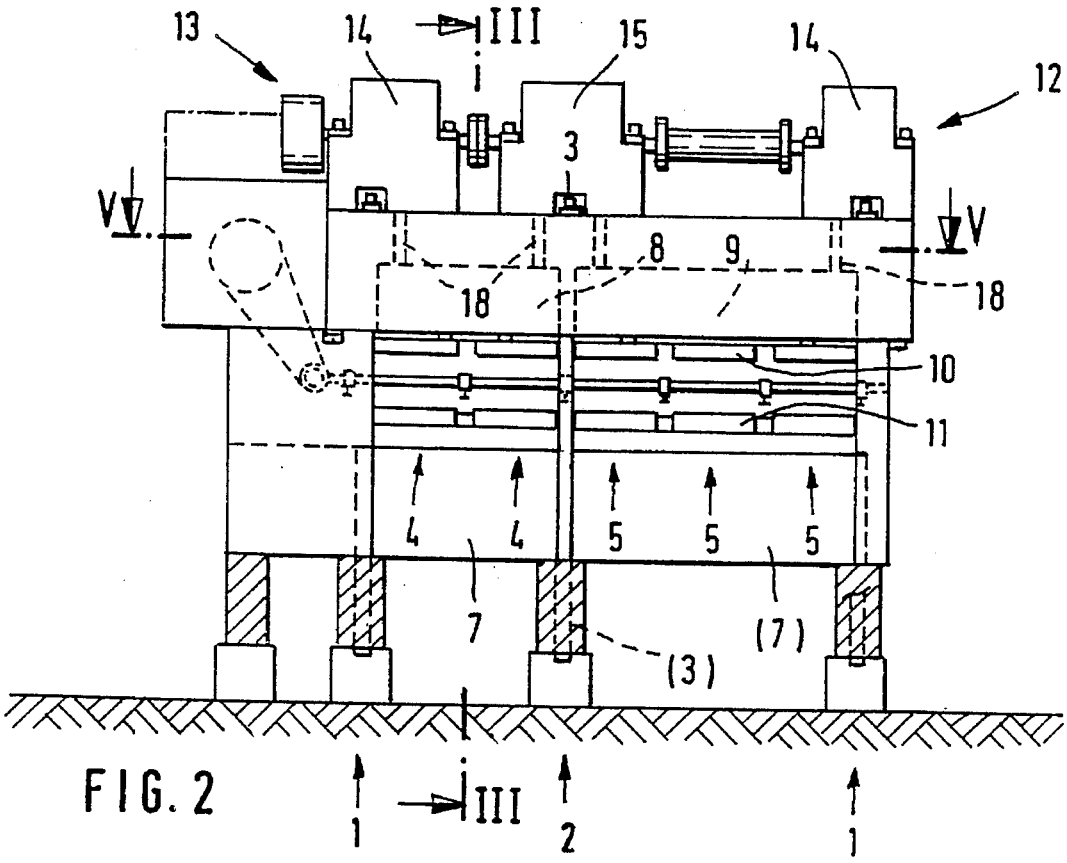
FIG. 2 is a frontal view of a press facility according to FIG. 1.
Figure 4:
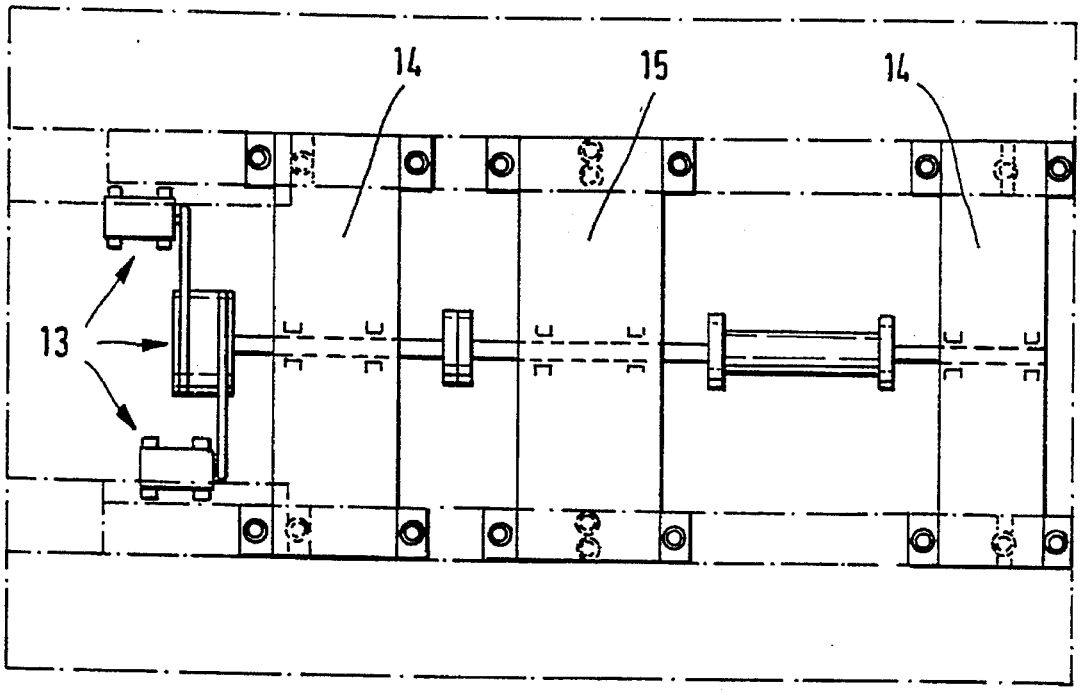
FIG. 4 is a top view of the press facility according to FIG. 2.
Figure 5:
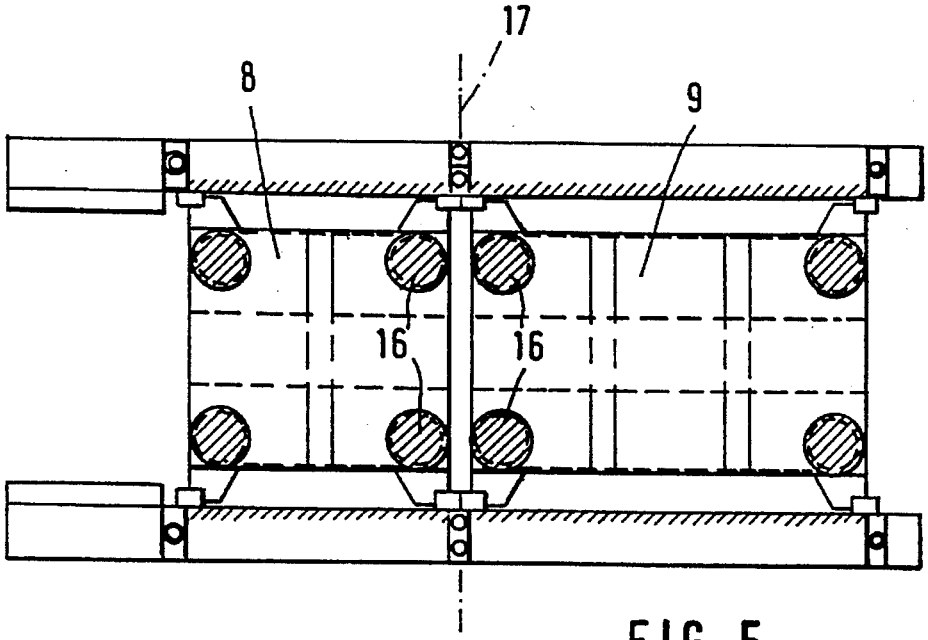
FIG. 5 is a view of section V—V indicated in FIG. 2.
Figure 9:
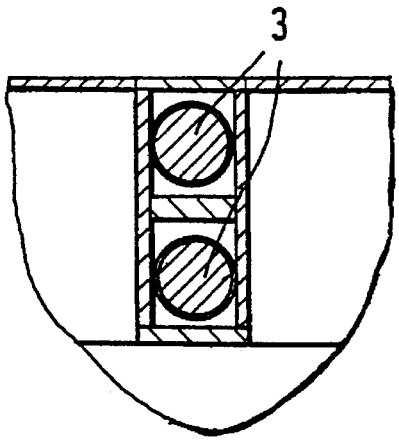
FIG. 9 is a partial view of section IX—IX indicated in FIG. 7.

The press facility of the present invention comprises a number of forming stations 4, 5 which follow one another in the passage direction 6 of the press, this passage direction 6 being the workpiece passage through the press facility. FIG. 1 also shows tie rods 3 which together with corresponding tie rod bushes form the actual press stands 1 and 2. Here, the mutually opposite press stands 2 have two tie rods 3 respectively (also FIG. 9) whose centers according to FIG. 5 are situated on a common center line 17. Corresponding to FIG. 2, the press facility also has bedplates 7 which are placed on the foundation via transverse bars, and press slides 8, 9 which are moved up and down via gearings in gear cases 14, 15 and connecting rods 18 by the motor drive 13 of a press drive, which has the general reference number 12. According to FIG. 4, the motor drive 13 acts upon the gear cases 14 and 15.

Figure 3:
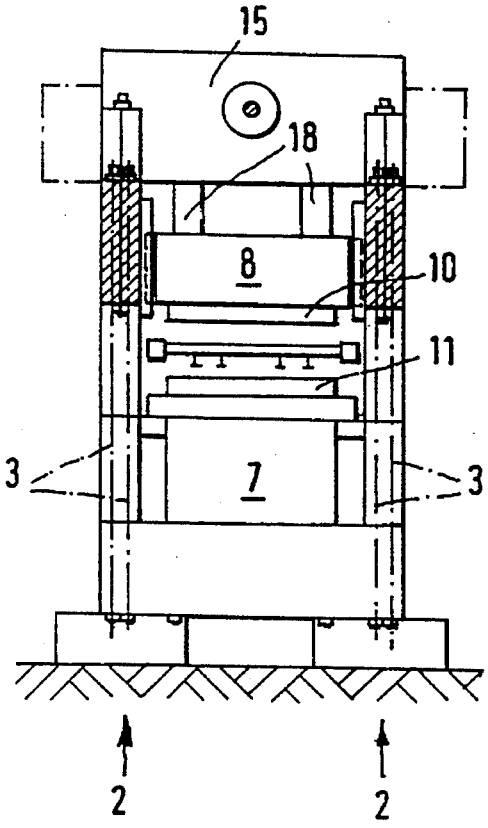
FIG. 3 is a view of section III—III indicated in FIG. 2.

As illustrated particularly in FIG. 3, tool halves 10, 11 are in each case oriented on the bedplate 7 and the press slides 8, 9. The illustrated press slides 8, 9 bridge the otherwise existing space between the mutually opposite press stands 2 and can be driven separately via the gearings in the gear case 15 which may have different designs and the respective other gearing 14 which is also situated in the intermediate stand area of the press stands 1 or above them.

The press slides 8, 9 are driven in certain embodiments by crankshaft mechanisms, toggle (joint) mechanisms, eccentric mechanisms and similar transmission devices.

Figure 6:
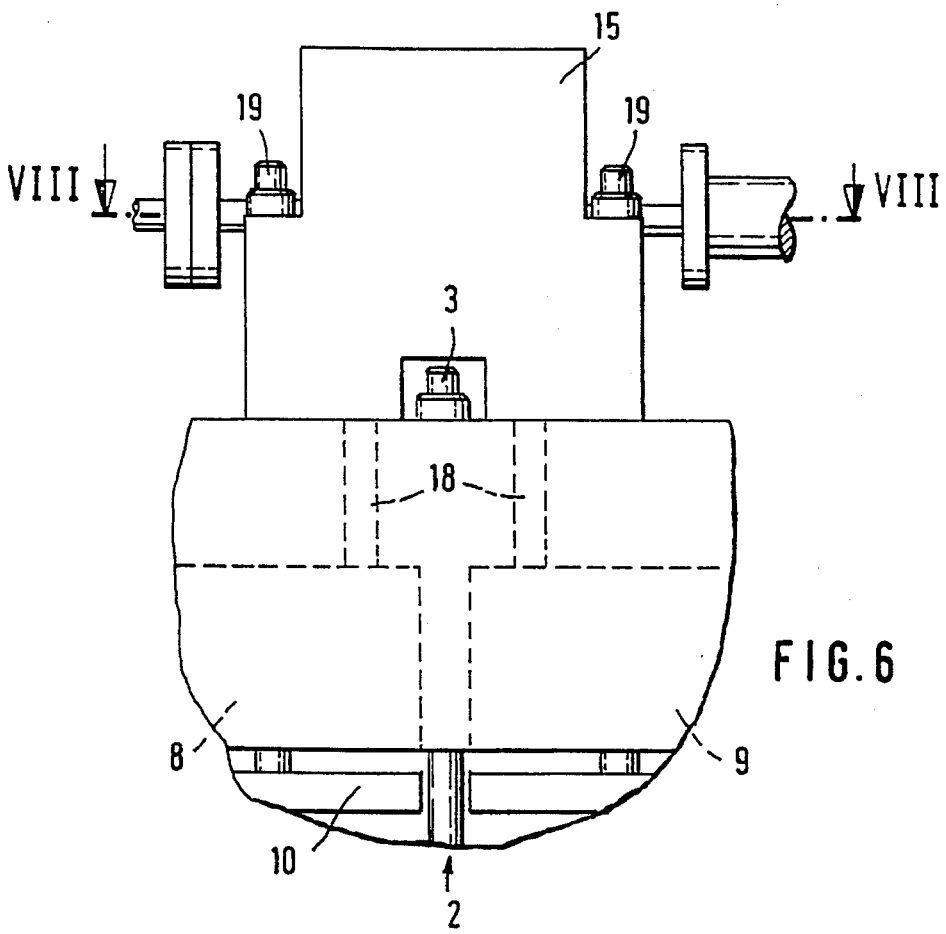
FIGS. 6 and 7 are detailed views of the connection of the gear case to the press stands.
Figure 7:
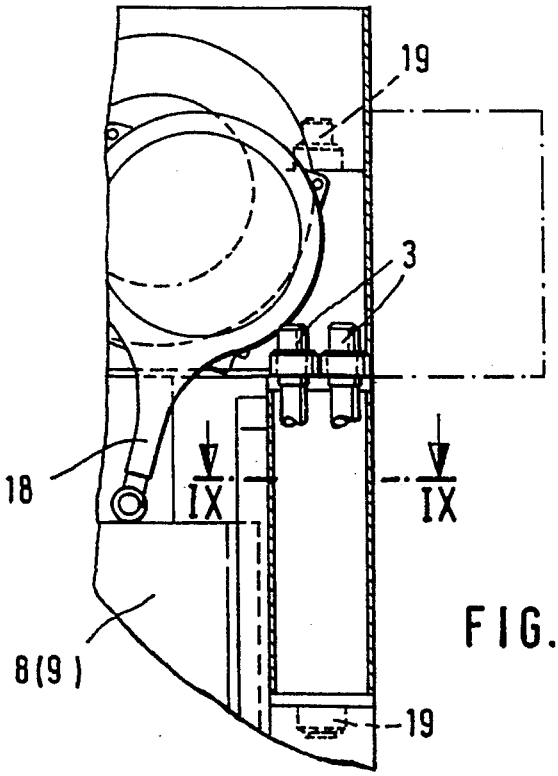
Figure 8:
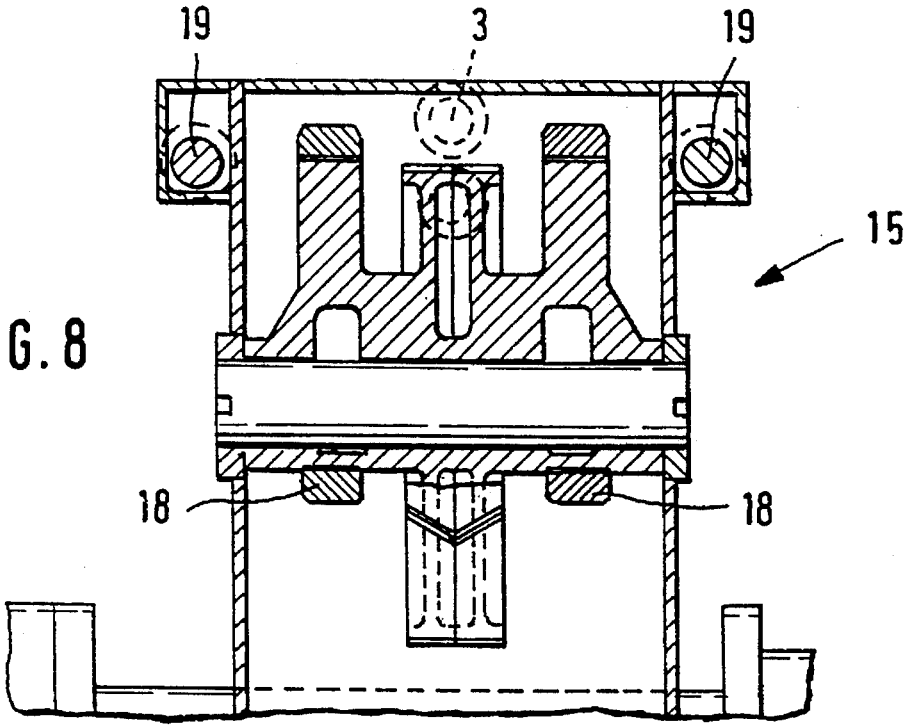
FIG. 8 is a partial view of section VIII—VIII indicated in FIG. 6.

As illustrated in FIGS. 6, 7 and 8, the gearings are disposed in gear cases 14 and 15 which are housed between the press stands 1 and 2 or above them. In the latter case, tie rods 19 for the fastening of the gear case 15 are provided on the press stands 2 or on longitudinal supports which are rigidly connected with the press stands 2. FIGS. 7 and 8 show a transmission construction, in this exemplary embodiment, a crank shaft mechanism with the same tap for a connecting rod 18, with a pair of connecting rods 18 being pivotally linked to the press slide 8; and a second pair of connecting rods 18 pivotally connected to press slide 9. It is understood that the gear cases 14 are designed corresponding to the gearing used in gear case 15. FIG. 5 shows the symmetrical introduction of force 16 from the gear case 15, via the gearings housed in it, into the press slides 8 and 9.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Press for feeding in a passage direction and forming sheet metal parts, comprising at least one bedplate, press slides, at least one pair of press stands associated with the press slides and the at least one bedplate, tool bottom parts associated with the at least one bedplate, tool upper parts arranged to interact with the tool bottom parts and operatively connected with the press slides, and a press drive means for driving the press slides and the associated tool top parts, wherein each of the press stands associated with each side of the press slides is constituted by at least two, substantially equal length tie rods which, together with tie rod bushes, are aligned with one another transversely to the passage direction.

2. The press according to claim 1, wherein the centers of the tie rods are arranged on a common line.

3. The press according to claim 1, wherein a force introduction into two press slides associated with one pair of press stands is symmetrical to the tie rods of the one pair of press stands.

* * * * *